US010324415B2

(12) United States Patent
Yokoi

(10) Patent No.: US 10,324,415 B2
(45) Date of Patent: Jun. 18, 2019

(54) DEVELOPING CARTRIDGE AND DRUM CARTRIDGE CONFIGURATION FOR MOUNTING TO AN IMAGE FORMING APPARATUS HAVING AN ELECTRIC CONTACT

(71) Applicant: Brother Kogyo Kabushiki Kaisha, Nagoya-shi Aichi-ken (JP)

(72) Inventor: Junichi Yokoi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/910,294

(22) Filed: Mar. 2, 2018

(65) Prior Publication Data

US 2018/0314202 A1 Nov. 1, 2018

(30) Foreign Application Priority Data

Apr. 28, 2017 (JP) ..... 2017-090454

(51) Int. Cl.
*G03G 15/08* (2006.01)
*G03G 21/16* (2006.01)
*G03G 21/18* (2006.01)

(52) U.S. Cl.
CPC ..... *G03G 21/1828* (2013.01); *G03G 21/1652* (2013.01); *G03G 21/1821* (2013.01); *G03G 15/0863* (2013.01); *G03G 21/1878* (2013.01); *G03G 2221/1678* (2013.01)

(58) Field of Classification Search
None
See application file for complete search history.

(56) References Cited

U.S. PATENT DOCUMENTS

2011/0129252 A1* 6/2011 Oda ..... G03G 21/1821 399/119
2013/0051849 A1 2/2013 Itabashi et al.
2013/0343777 A1* 12/2013 Amann ..... G03G 15/0863 399/90
2015/0037059 A1* 2/2015 Yang ..... G03G 15/0863 399/90

FOREIGN PATENT DOCUMENTS

JP 2013-054058 A 3/2013

* cited by examiner

*Primary Examiner* — Victor Verbitsky
(74) *Attorney, Agent, or Firm* — Banner & Witcoff, Ltd.

(57) ABSTRACT

An image forming apparatus includes a developing cartridge, a drum cartridge, and an electric contact. The developing cartridge includes a holder having a resilient member. In a state where the holder is positioned at a first position, the resilient member has a first length and the electric contact surface is in contact with the electric contact. In a state where the holder is positioned at a second position, the resilient member has a second length in the third direction longer than the first length and the electric contact surface is in contact with the electric contact. In a state where the holder moves from the first position to the second position, the holder pivots in a state where the holder is in contact with the first contact surface.

13 Claims, 11 Drawing Sheets

DEVELOPING CARTRIDGE AND DRUM CARTRIDGE CONFIGURATION FOR MOUNTING TO AN IMAGE FORMING APPARATUS HAVING AN ELECTRIC CONTACT

CROSS REFERENCE TO RELATED APPLICATION

This application claims priority from Japanese Patent Application No. 2017-090454 filed Apr. 28, 2017. The entire content of the priority application is incorporated herein by reference.

TECHNICAL FIELD

The disclosure relates to an image forming apparatus.

BACKGROUND

There is an electrophotographic image forming apparatus known in the prior art such as a laser printer and LED printer. The image forming apparatus includes a developing cartridge, which has a developing roller for supplying a developing agent.

The developing cartridge in the art is attached to a drum cartridge, which includes a photosensitive drum. In a state where the photosensitive drum is attached to the drum cartridge, the photosensitive drum and the developing roller contact with each other, and accordingly, the drum cartridge attached to the developing cartridge is attached to the image forming apparatus.

SUMMARY

Further, there is a developing cartridge known in the prior art that includes a storage medium. The storage medium is an IC chip, for example. The storage medium has an electric contact surface, which contacts with a terminal portion of the image forming apparatus. During detachment of the developing cartridge from the image forming apparatus, the electric contact surface rubs against a portion of the image forming apparatus.

The object of the disclosure is to reduce rubbing of the electric contact surface in the image forming apparatus that uses the developing cartridge having the electric contact surface.

According to one aspect, an image forming apparatus including a developing cartridge, a drum cartridge, electric contact, and a frame. The developing cartridge includes a casing, a storage medium, and a holder. The developing roller is rotatable about a first rotating axis extending in a first direction. The casing is configured to accommodate a developing agent and having one end portion in a second direction where the developing roller is positioned. The storage medium has an electric contact surface. The holder is positioned at one end portion of the casing in the first direction, and holds the electric contact surface. The holder has a first outer surface, a second outer surface, and a resilient member. The first outer surface is positioned at one side of the holder in a third direction crossing the electric contact surface, and holds the electric contact surface. The second outer surface is positioned at another side of the holder in the third direction, and is positioned away from the first outer surface in the third direction. The resilient member is positioned between the first outer surface and the second outer surface, and is configured to be compressed and expanded in the third direction. The drum cartridge includes a photosensitive drum rotatable about a second rotating axis extending in the first direction. The electric contact is configured to be in contact with the electric contact surface. The developing cartridge is attachable to the frame in a state where the developing cartridge is attached to the drum cartridge. The frame has a first guide surface configured to guide at least a part of the first outer surface, and is configured to contact with at least a part of the first outer surface during attachment of the developing cartridge to the frame. The first guide surface has a first contact surface positioned opposite to the developing roller in the second direction with respect to the electric contact surface. The holder is movable relative to the frame from a first position to a second position during detachment of the developing cartridge from the frame. In a state where the holder is positioned at the first position, the resilient member has a first length in the third direction and the electric contact surface is in contact with the electric contact. In a state where the holder is positioned at the second position, the resilient member has a second length in the third direction longer than the first length and the electric contact surface is in contact with the electric contact. In a state where the holder moves from the first position to the second position, the holder pivots about a part of the first outer surface in a state where the holder is in contact with the first contact surface of the first guide surface.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
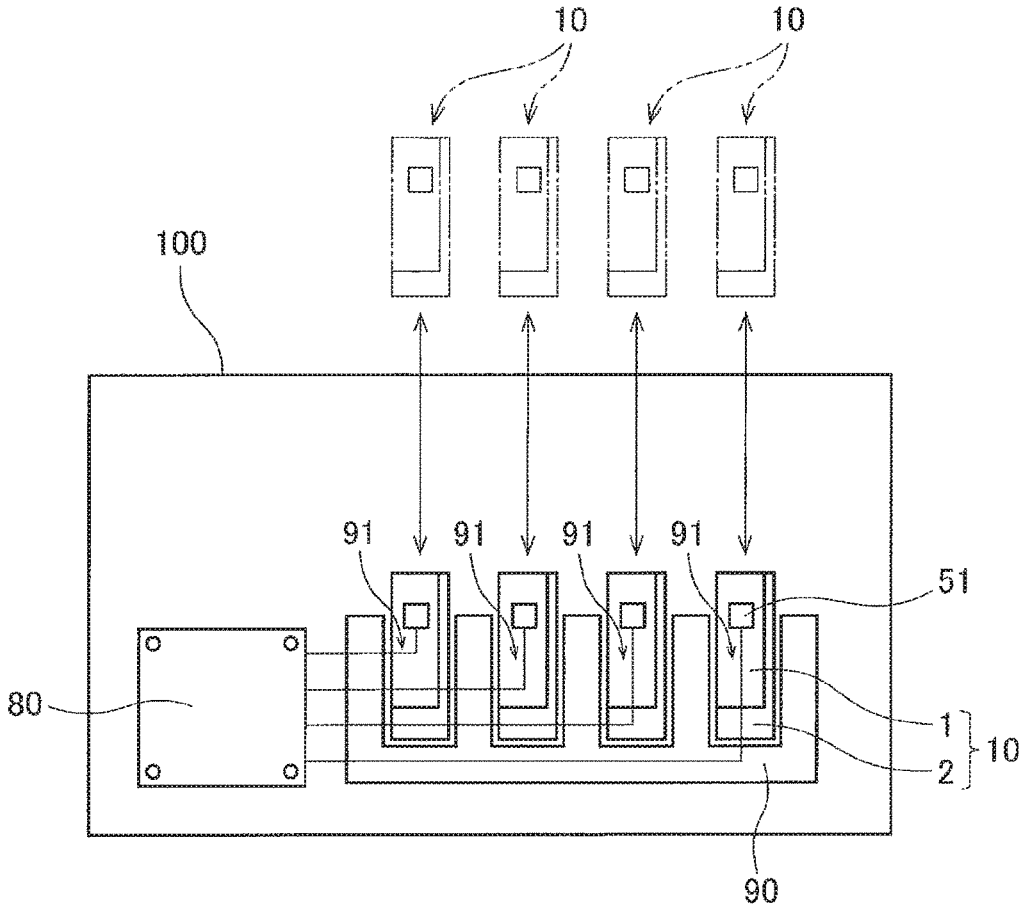
FIG. 1 is a conceptual view of an image forming apparatus according to an embodiment.

An image forming apparatus 100 according to an embodiment will be described while referring to the accompanying drawings wherein like parts and components are designated by the same reference numerals to avoid duplicating description.

<1. Configuration of Image Forming Apparatus>

FIG. 1 is a conceptual view of the image forming apparatus 100. A laser printer and an LED printer are examples of the image forming apparatus 100.

The image forming apparatus 100 has four process cartridges 10 and a drum cartridge holder 90. The process cartridge 10 includes a developing cartridge 1 and a drum cartridge 2. The developing cartridge 1 is attached to the drum cartridge 2. The four developing cartridges 1 accommodate developing agents having different colors from each other, such as cyan, magenta, yellow, and black. It is noted that the number of developing cartridges may be from one to three, or more than four. The drum cartridge holder 90 is a frame to which the process cartridge 10 is attached. The drum cartridge holder 90 includes four slots 91. Each process cartridge 10 is attached to each slot 91. The image forming apparatus 100 forms images on printing faces of printing sheets by the developing agents (toner, for example) supplied from each developing cartridge 1 in the four process cartridges 10.

Each of the four developing cartridges 1 has an IC chip 51. The IC chip 51 is a storage medium, which information can be read out from and written in. The image forming apparatus 100 includes a control unit 80. In a state where the process cartridge 10 is attached to the slot 91 of the drum cartridge holder 90, the IC chip 51 of each developing cartridge 1 and the control unit 80 are electrically connected. The control unit 80 is configured of a circuit board. The control unit 80 includes a processor such as a CPU and several types of memories. The control unit 80 executes processes in the image forming apparatus 100 with the processor working in accordance with programs.

<2. Process Cartridge>

<2.1 Developing Cartridge>

Figure 2:
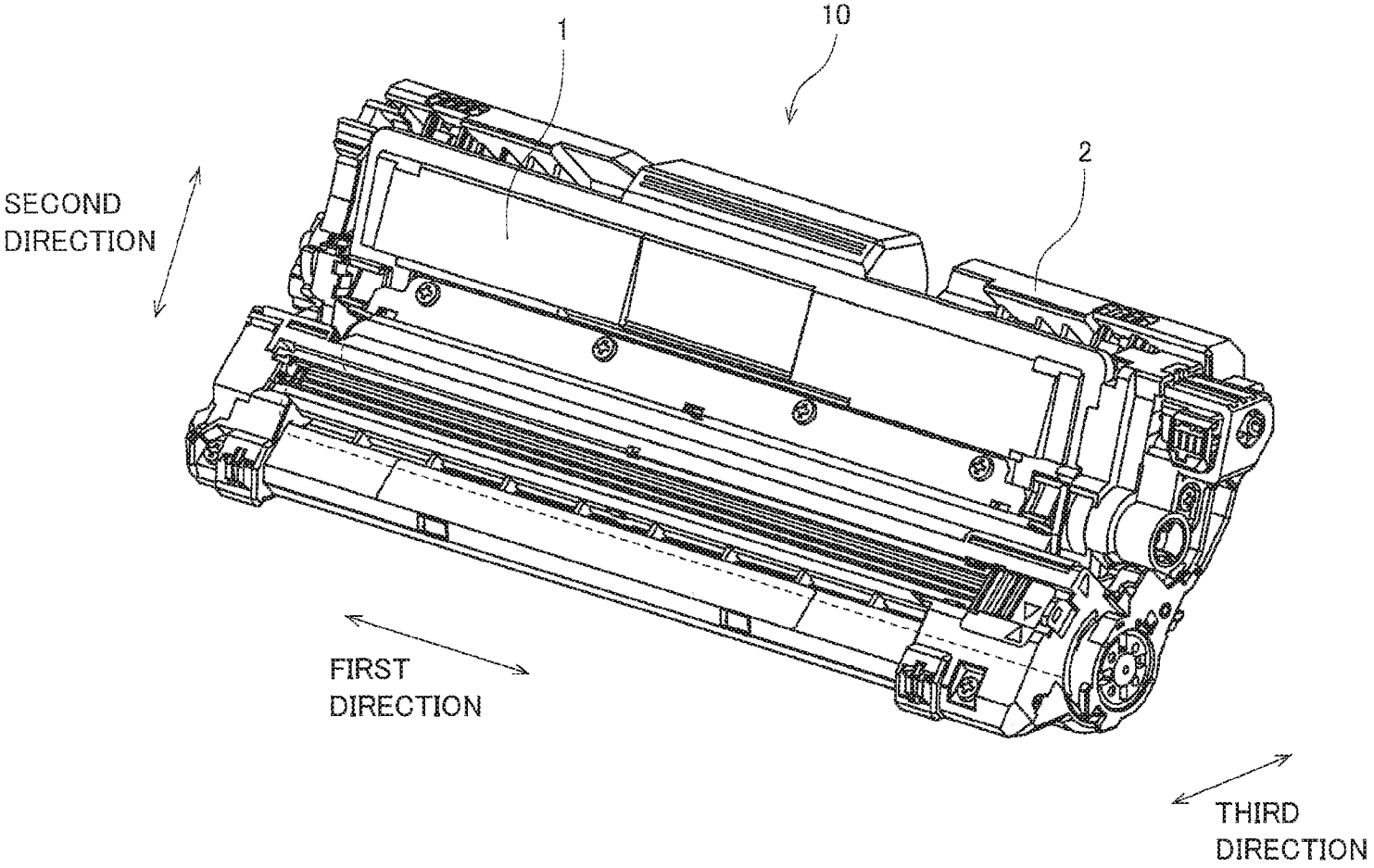
FIG. 2 is a perspective view of a process cartridge according to the embodiment.

FIG. 2 is a perspective view of the process cartridge 10. As described above, the process cartridge 10 includes the developing cartridge 1 and the drum cartridge 2. The developing cartridge 1 is attachable to and detachable from the drum cartridge 2. The user of the image forming apparatus 100 can exchange only one of the developing cartridge 1 and the drum cartridge 2 for a new cartridge. Accordingly, each product life of the developing cartridge 1 and the drum cartridge 2 can be consumed efficiently.

Figure 3:
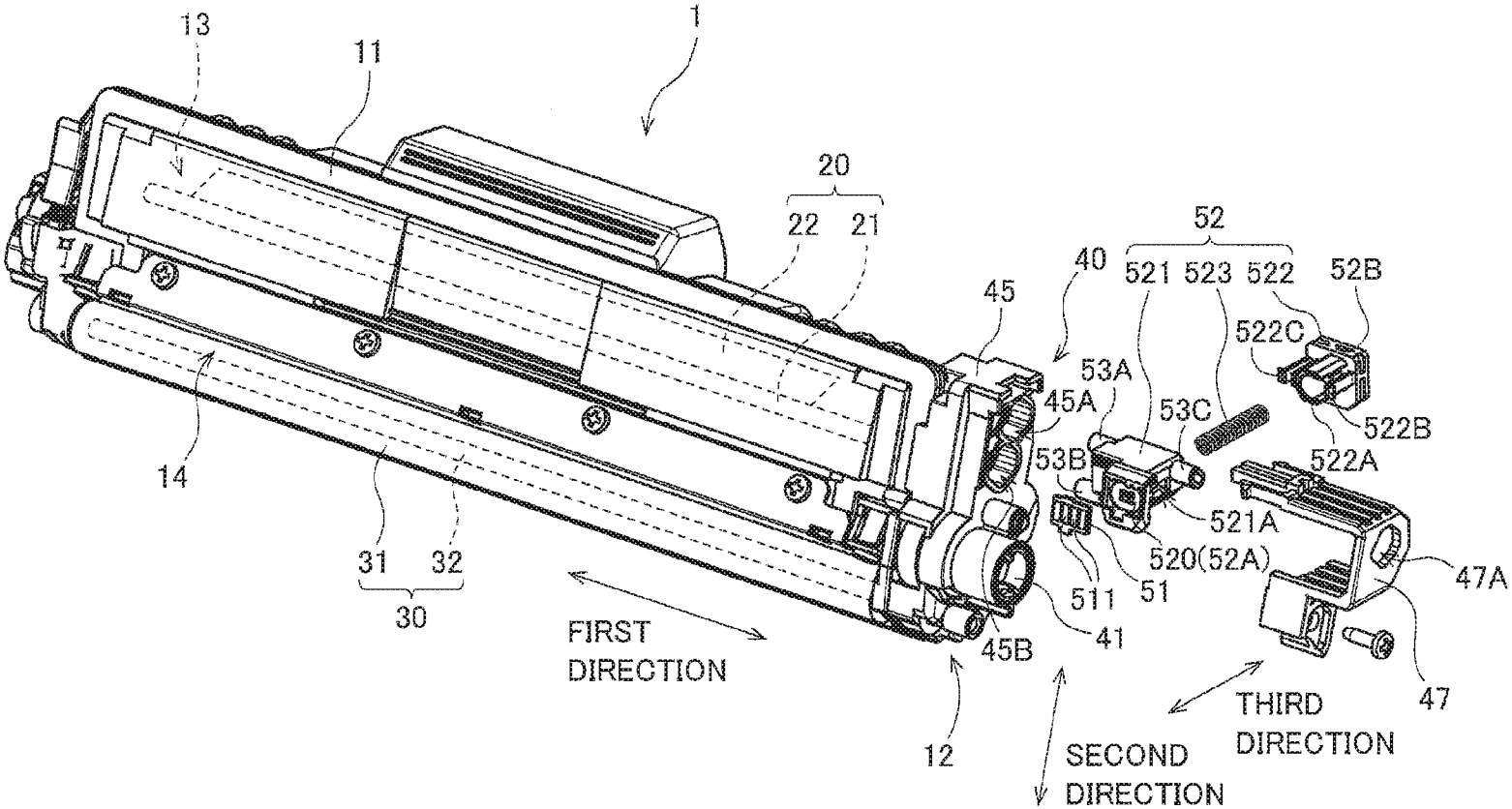
FIG. 3 is a perspective view of a developing cartridge according to the embodiment.

FIG. 3 is a perspective view of the developing cartridge 1. FIG. 3 indicates an exploded view of a part of the developing cartridge 1. As illustrated in FIG. 3, the developing cartridge 1 includes a casing 11, an agitator 20, a developing roller 30, a gear portion 40, and an IC chip assembly 50.

The casing 11 is a housing configured to accommodate a developing agent. The casing 11 extends in one direction. Hereinafter, in a state where the developing cartridge 1 is attached to the image forming apparatus 100, the direction in which the casing 11 extends will be referred to as "first direction." The direction crossing (preferably, perpendicular to) the first direction will be referred to as "second direction." In a state where the developing cartridge 1 is attached to the image forming apparatus 100, the developing roller 30 is positioned at one end portion of the casing 11 in the second direction. The second direction is also the attaching and detaching direction of the process cartridge 10 relative to the slot 91 of the drum cartridge holder 90 of the image forming apparatus 100. The direction crossing (preferably, perpendicular to) both of the first and second directions will be referred to as "third direction." Here, in a state where the developing cartridge 1 is attached to the image forming apparatus 100, the third direction crosses an electric contact surface 511 of the IC chip 51, which will be described later.

The casing 11 therein has an accommodating chamber 13. The developing agent is accommodated in the accommodating chamber 13. The casing 11 has an opening 14. The opening 14 is positioned at an end portion of the casing 11 in an attaching direction, in which the developing cartridge 1 is attached to the drum cartridge 2. The accommodating chamber 13 and the external space of the casing 11 are communicated through the opening 14.

The agitator 20 includes an agitator shaft 21 and an agitator blade 22. The agitator shaft 21 extends in the first direction. The agitator blade 22 expands radially outward from the agitator shaft 21. The agitator blade 22 and a part of the agitator shaft 21 are positioned inside of the accommodating chamber 13. The gear portion 40 includes an agitator gear that is connected to one end portion of the agitator shaft 21 in the first direction. The agitator shaft 21 and the agitator blade 22 is rotatable together with the agitator gear. When the agitator blade 22 rotates, the developing agent in the accommodating chamber 13 is agitated.

The developing roller 30 is rotatable about a rotating axis (first rotating axis) extending in the first direction. The developing roller 30 is positioned at the opening 14 of the casing 11. The developing roller 30 includes a developing roller body 31 and developing roller shaft 32. The developing roller body 31 is a cylindrical member extending in the first direction. The developing roller body 31 is made from material such as rubber having resiliency. The developing roller shaft 32 is made from material such as metal or resin that has electrical conductivity. The developing roller body 31 is fixed to the developing roller shaft 32 so that the developing roller body 31 cannot rotate relative to the developing roller shaft 32.

The gear portion 40 includes a developing roller gear, and an end portion of the developing roller shaft 32 in the first direction is fixed to the developing roller gear so that the end portion of the developing roller shaft 32 cannot rotate relative to the developing roller gear. When the developing roller gear rotates, the developing roller shaft 32 rotates so as to rotate the developing roller body 31 together with the developing roller shaft 32.

It is noted that the developing roller shaft 32 may not penetrate the developing roller body 31 in the first direction. For example, the developing roller 30 may include a pair of developing roller shafts 32 each extending in the first direction from each end portion of the developing roller body 31.

Further, the developing cartridge 1 includes a supply roller, not illustrated. The supply roller is positioned between the developing roller 30 and the accommodating chamber 13. The supply roller is rotatable about a rotating axis extending in the first direction. When the developing cartridge 1 receives drive force, the developing agent is supplied to the outer peripheral surface of the developing roller 30 through the supply roller from the accommodating chamber 13 of the casing 11. Simultaneously, the developing agent is electrically charged by the triboelectric charging between the supply roller and the developing roller 30. Meanwhile, the developing roller shaft 32 of the developing roller 30 is electrically biased. Accordingly, the developing agent is attracted to the outer peripheral surface of the developing roller body 31 by the electrostatic force exerted between the developing roller shaft 32 and the developing agent.

The developing cartridge 1 further includes a thickness-regulating blade, not illustrated. The thickness-regulating blade regulates the thickness of the developing agent supplied on the outer peripheral surface of the developing roller body 31 to a constant thickness. Subsequently, the developing agent is supplied to a photosensitive drum 72 in the drum cartridge 2, which will be described later, from the outer peripheral surface of the developing roller body 31. The developing agent moves from the developing roller body 31 to the photosensitive drum 72 on the basis of the electrostatic latent image formed on the outer peripheral surface of the photosensitive drum 72. Accordingly, the electrostatic latent image is converted into a visible image on the outer peripheral surface of the photosensitive drum 72.

The gear portion 40 is positioned at a first end face 12, which is one end face in the first direction of the casing 11. The gear portion 40 includes a coupling 41, a gear cover 45, and a plurality of gears including the agitator gear and the developing roller gear described above. The gear cover 45 is fixed to the first end face 12 of the casing 11 by screws, for example. At least part of the plurality of gears is positioned between the first end face 12 and the gear cover 45. The coupling 41 is exposed from the gear cover 45. The image forming apparatus 100 has a driving shaft, and in a state where the process cartridge 10 is attached to the image forming apparatus 100, the driving shaft of the image forming apparatus 100 is connected to the coupling 41. The rotation of the driving shaft is transmitted via the coupling 41 to the plurality of gears, including the agitator gear and the developing roller gear.

The developing cartridge 1 further includes holder cover 47. The holder cover 47 is fixed to the gear cover 45. The holder cover 47 is positioned opposite to the casing 11 with respect to the gear cover 45 in the first direction.

The plurality of gears of the gear portion 40 may be gears transmitting rotating force by engagements of teeth. Alternatively, the plurality of gears may be gears transmitting rotating force by friction between the gears.

The IC chip assembly 50 includes an IC chip 51 that is a storage medium and a holder 52 that supports the IC chip 51. The IC chip 51 includes four electric contact surfaces 511. The electric contact surface 511 is made from metal having electric conductivity. Further, the IC chip 51 can store various types of information about the developing cartridge 1. It is noted that the number of the electric contact surface 511 of the IC chip 51 may be from one to three, or more than four.

The holder 52 has a first outer surface 52A and a second outer surface 52B. The first outer surface 52A is positioned at one end portion in the third direction of the holder 52. The second outer surface 52B is positioned at the other end portion in the third direction of the holder 52. The first outer surface 52A is movable in the third direction relative to the second outer surface 52B.

Specifically, the holder 52 includes a first holder member 521, a second holder member 522, and a coil spring 523 positioned between the first holder member 521 and the second holder member 522. The first holder member 521 is made from resin, for example. The first holder member 521 has the first outer surface 52A. The IC chip 51 is fixed to a supporting surface 520 of the first outer surface 52A. The second holder member 522 has the second outer surface 52B. In the assembled state of the holder 52, the first outer surface 52A and the second outer surface 52B are separated from each other in the third direction.

The coil spring 523 is a resilient member configured to be compressed and expanded in the third direction. The coil spring 523 is positioned between the first outer surface 52A and the second outer surface 52B in the third direction. The coil spring 523 may be directly connected to the first outer surface 52A and the second outer surface 52B, or may be indirectly connected to the first outer surface 52A and the second outer surface 52B through a connecting member. The length of the coil spring 523 in the third direction changes at least between a first length and a second length longer than the first length. In the embodiment, the length of the coil spring 523 in the third direction changes between the first length, the second length, a third length, and a fourth length, where the third length is longer than the second length and the fourth length is longer than the third length. The distance between the first outer surface 52A and the second outer surface 52B in the third direction in a state where the coil spring 523 has the second length is longer than the distance between the first outer surface 52A and the second outer surface 52B in the third direction in a state where the coil spring 523 has the first length. The first length is shorter than the natural length of the coil spring 523.

The second holder member 522 includes a spring holder 522A having a cylindrical shape. The spring holder 522A protrudes from the main body of the second holder member 522 in the third direction. The coil spring 523 is inserted in the spring holder 522A. Inside of the spring holder 522A, a protrusion having a cylindrical shape, not illustrated, is positioned. The protrusion is inserted radially inside of the coil spring 523. Accordingly, the coil spring 523 is supported by both of the outer peripheral surface of the protrusion and the inner peripheral surface of the spring holder 522A.

The second holder member 522 includes a first claw portion 522B and a second claw portion 522C. Each of the first claw portion 522B and the second claw portion 522C protrudes in a direction crossing the third direction. On the other hand, the first holder member 521 includes a first opening 521A. The first claw portion 522B is inserted in the first opening 521A. The first holder member 521 also has a second opening, not illustrated, into which the second claw portion 522C is inserted.

In a state where the coil spring 523 has the fourth length, the first claw portion 522B contacts with the first holder member 521 at the edge of the first opening 521A adjacent to the second outer surface 52B. In a state where the coil spring 523 has the fourth length, the second claw portion 522C contacts with the first holder member 521 at the edge of the second opening adjacent to the second outer surface 52B. Accordingly, the length of the coil spring 523 in the third direction is prevented from being longer than the fourth length. Further, the first holder member 521 is prevented from being detached from the second holder member 522. On the other hand, in a state where the coil spring 523 is the first, second and third lengths, the first claw portion 522B and the second claw portion 522C are separated from the first holder member 521.

The IC chip 51 is fixed to the supporting surface 520 of the first outer surface 52A of the first holder member 521. That is, in a state where the first holder member 521 moves relative to the second holder member 522 in the third direction, the electric contact surface 511 moves in the third direction. It is noted that the IC chip 51 is fixed to a portion recessed from the first outer surface 52A toward the second holder member 522 in the third direction.

The first holder member 521 includes a boss 53A, a boss 53B, and a boss 53C. Each of the boss 53A and the boss 53B extends toward the gear cover 45 from a surface of the first holder member 521 in the first direction. The surface of the holder member 521 faces the gear cover 45. The gear cover 45 has a through-hole 45A and a through-hole 45B. Each of the through-hole 45A and the through-hole 45B penetrates the gear cover 45 in the first direction. The boss 53A is inserted in the through-hole 45A. The boss 53B is inserted in the through-hole 45B.

The boss 53C extends toward the holder cover 47 from another surface of the first holder member 521 in the first direction. Another surface of the first holder member 521 faces the holder cover 47. On the other hand, the holder cover 47 has a through-hole 47A. The through-hole 47A penetrates the holder cover 47 in the first direction. The boss 53C is inserted in the through-hole 47A.

The length (internal dimension) of the through-hole 47A in the second direction is greater than the length (external dimension) of the boss 53C in the second direction. The length (internal dimension) of the through-hole 45A in the second direction is greater than the length (external dimension) of the boss 53A in the second direction. Further, the length (internal dimension) of the through-hole 45B in the second direction is greater than the length (external dimension) of the boss 53B in the second direction. Accordingly, the holder 52 is movable together with the boss 53A, the boss 53B, and the boss 53C in the second direction relative to the gear cover 45 and the holder cover 47. When the holder 52 moves in the second direction, the IC chip 51 having the electric contact surface 511 moves together with the holder 52 in the second direction.

The length (internal dimension) of the through-hole 47A in the third direction is greater than the length (external dimension) of the boss 53C in the third direction. The length (internal dimension) of the through-hole 45A in the third direction is greater than the length (external dimension) of the boss 53A in the third direction. Further, the length (internal dimension) of the through-hole 45B in the third direction is greater than the length (external dimension) of the boss 53B in the third direction. Accordingly, the holder 52 is movable together with the boss 53A, the boss 53B, and the boss 53C in the third direction relative to the gear cover 45 and the holder cover 47. When the holder 52 moves in the third direction, the IC chip 51 having the electric contact surface 511 moves together with the holder 52 in the third direction.

It is noted that the gear cover 45 may have, in lieu of the through-hole 45A, a recessed portion to which the boss 53A can be inserted. The gear cover 45 may have, in lieu of the through-hole 45B, a recessed portion to which the boss 53B can be inserted. The gear cover 45 may have, in lieu of the gear cover 45C, a recessed portion to which the boss 53C can be inserted. Further, the gear cover 45 may have a boss and the first holder member 521 may have a through hole or recessed portion to which the boss can be inserted. The holder cover 47 may have a boss and the first holder member 521 may have a through hole or recessed portion to which the boss can be inserted.

That is, one of the holder 52 and the housing that is configured of the casing 11, the gear cover 45, and the holder cover 47 may have a boss, and the other one of the holder 52 and the housing may have a through-hole or recessed portion to which the boss is inserted.

<2.2 Drum Cartridge>

Figure 4:
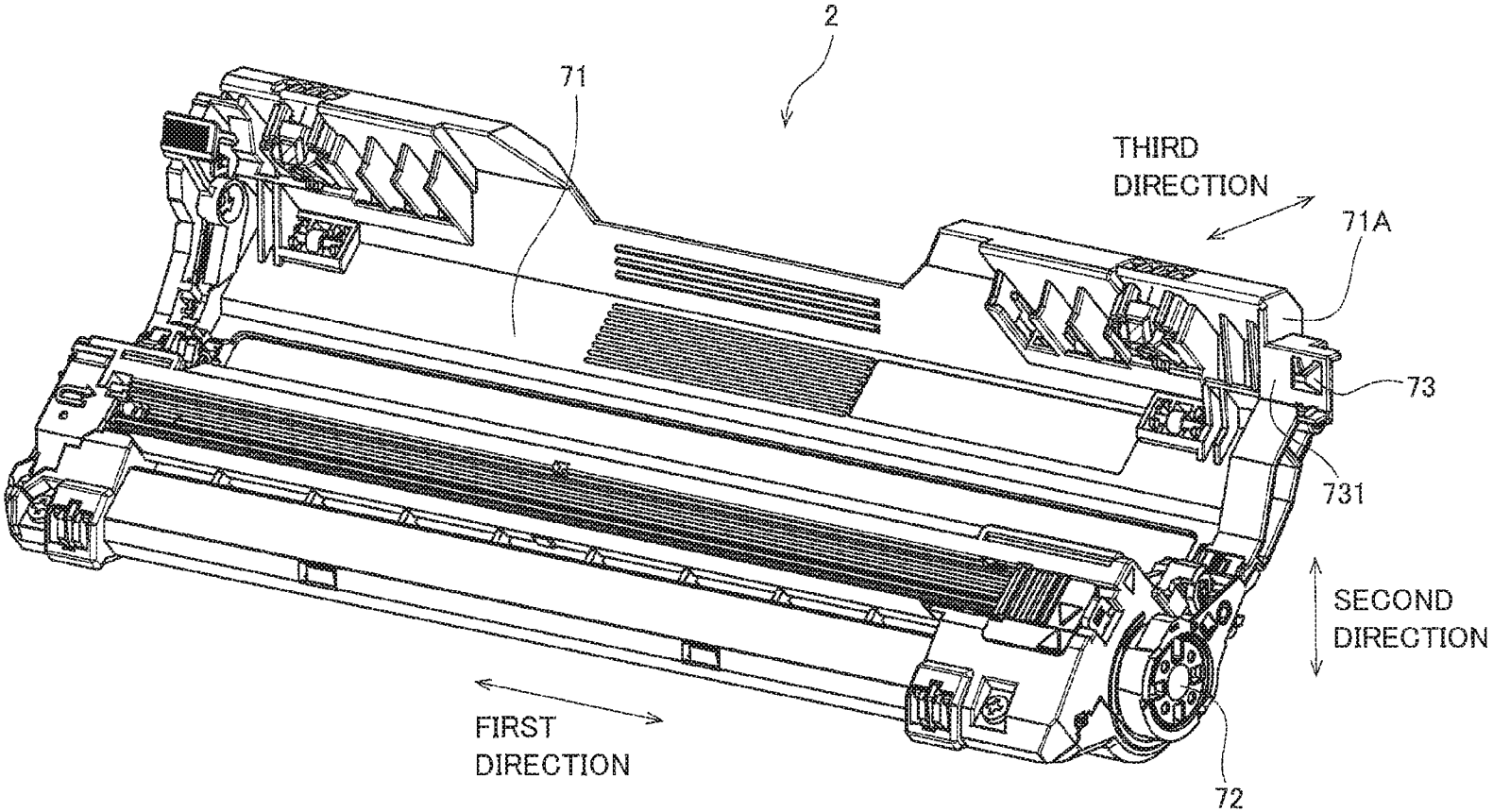
FIG. 4 is a perspective view of a drum cartridge according to the embodiment.

FIG. 4 is a perspective view of the drum cartridge 2. The drum cartridge 2 has a developing cartridge supporting portion 71 that can support the developing cartridge 1. A photosensitive drum 72 is positioned at the developing cartridge supporting portion 71. The photosensitive drum 72 is rotatable about a rotating axis (second rotating axis) extending in the first direction. In a state where the developing cartridge 1 is attached to the drum cartridge 2, the developing roller 30 of the developing cartridge 1 contacts with the photosensitive drum 72. The drum cartridge 2 to which the developing cartridge 1 is attached is attached to the drum cartridge holder 90 (see, FIG. 1) of the image forming apparatus 100.

A supporting plate 731 is positioned at the developing cartridge supporting portion 71A that is one end surface of the developing cartridge supporting portion 71 in the first direction. In a state where the developing cartridge 1 is attached to the drum cartridge 2, the supporting plate 731 is at a position where the second outer surface 52B of the holder 52 faces the supporting plate 731 in the third direction. The supporting plate 731 has a surface extending in each of the first and second directions, and a protruding portion 73 is positioned at the surface. The protruding portion 73 protrudes toward the holder 52 from the surface of the supporting plate 731 in the third direction. The protruding portion 73 has a substantially square pyramid shape gradually converging toward the holder 52 in the third direction.

On the other hand, the second holder member 522 of the IC chip assembly 50 has a recess 522D in the second outer surface 52B (see, FIGS. 8-12). The recess 522D forms a substantially square pyramid shape gradually converging toward the first holder member 521 from the second outer surface 52B in the third direction. In a state where the developing cartridge 1 is attached to the drum cartridge 2, the protruding portion 73 of the drum cartridge 2 is fitted in the recess 522D of the second holder member 522. Accordingly, the second outer surface 52B of the second holder member 522 and the supporting plate 731 are in contact with each other. That is, the supporting plate 731 and the protruding portion 73 serve as a holder supporting portion that supports the holder 52 of the IC chip assembly 50.

Incidentally, the length of the recess 522D in the second direction is longer than the length of the protruding portion 73 in the second direction. Accordingly, even in a state where the developing cartridge 1 is attached to the drum cartridge 2, the second outer surface 52B of the holder 52 is movable relative to the supporting plate 731 and the protruding portion 73 in the second direction. Accordingly, the holder 52 can be rotated during the detaching operation of the process cartridge 10, described later.

<3. Drum Cartridge Holder>

Figure 5:
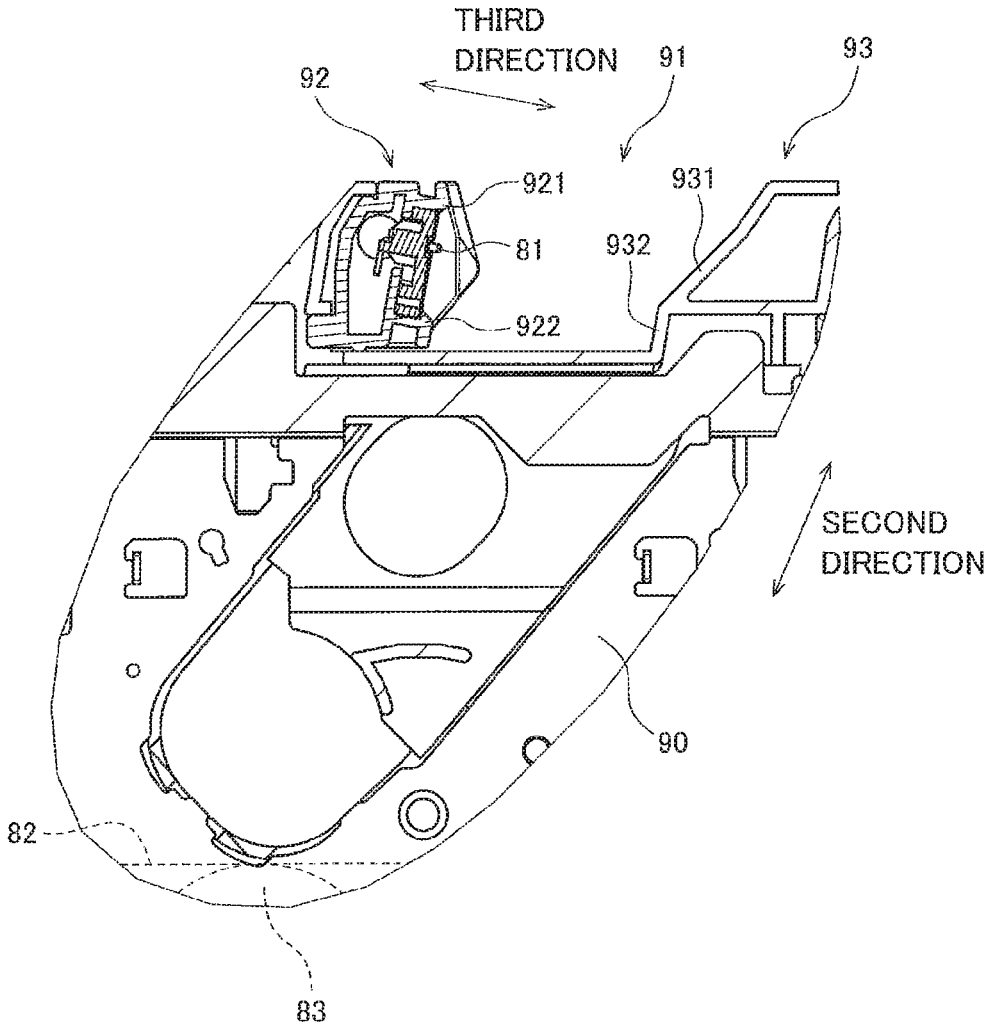
FIG. 5 illustrates a cross-section of a drum cartridge supporting portion taken adjacent to one of slots according to the embodiment.
Figure 6:
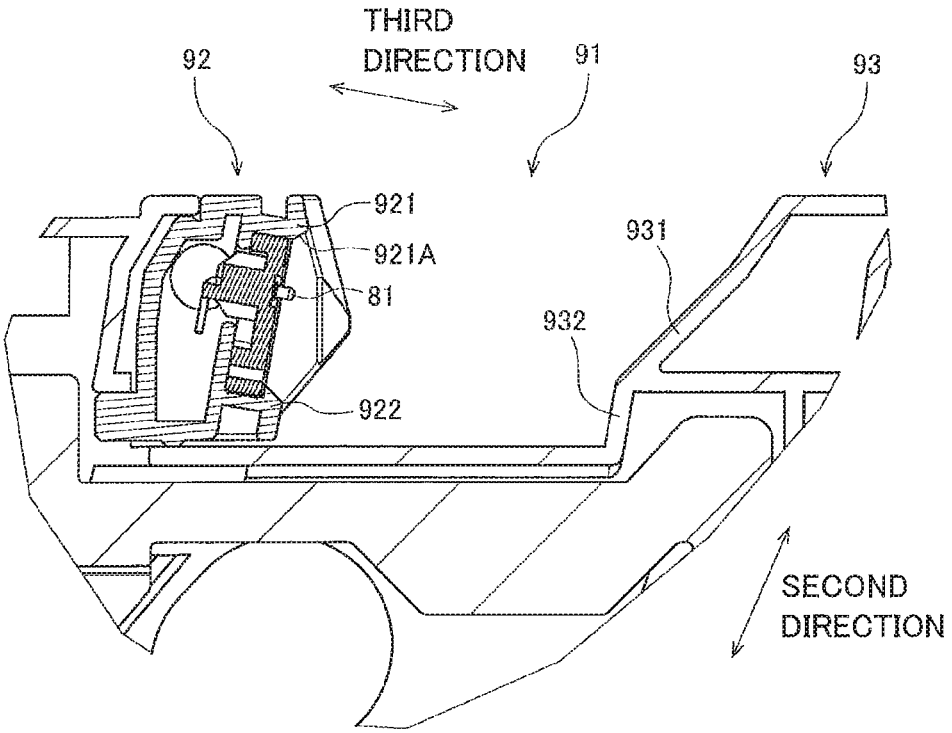
FIG. 6 is a cross-sectional view of a first guide surface and a second guide surface according to the embodiment.
Figure 7:
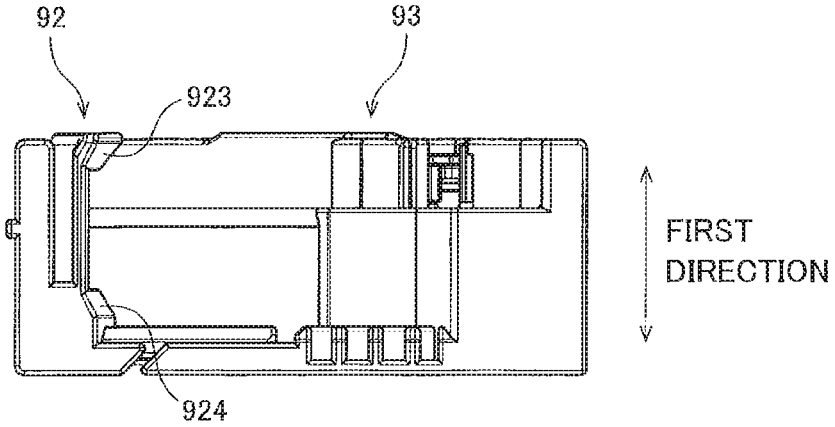
FIG. 7 is a plan view of the first guide surface and the second guide surface.

The drum cartridge holder 90 of the image forming apparatus 100 has four slots 91. FIG. 5 illustrates a cross-section of the drum cartridge holder 90 taken adjacent to one of the slots 91. FIG. 6 is a cross-sectional view of the first guide surface 92 and the second guide surface 93. FIG. 7 is a plan view of the first guide surface 92 and the second guide surface 93.

The drum cartridge holder 90 has a first guide surface 92 and a second guide surface 93. The slot 91 has an inserting opening into which the process cartridge 10 is inserted, and the first guide surface 92 and the second guide surface 93 are positioned in the inserting opening. The first guide surface 92 and the second guide surface 93 face each other in the third direction. The first guide surface 92 is positioned spaced apart from the second guide surface 93 in the third direction. In a state where the process cartridge 10 is inserted in the slot 91, the IC chip assembly 50 is inserted between the first guide surface 92 and the second guide surface 93.

The first guide surface 92 is a portion that contacts at least part of the first outer surface 52A of the holder 52. The first guide surface 92 is configured to guide the first outer surface 52A during detachment or attachment of the process cartridge 10 with respect to the drum cartridge holder 90. The first guide surface 92 supports the electric connector 81 that is made from metal and is configured to contact with the electric contact surface 511 of the IC chip 51. The electric connector 81 is an electric contact protruding toward the second guide surface 93 from the surface of the first guide surface 92 in the third direction. The first guide surface 92 has a first protruding portion 921 and a second protruding portion 922 that are arrayed in the second direction. The electric connector 81 is positioned between the first protruding portion 921 and the second protruding portion 922 in the second direction. The first protruding portion 921 is positioned closer to the inserting opening in the second direction than the electric connector 81 is to the inserting opening. Each of the first protruding portion 921 and the second protruding portion 922 protrudes further toward the second guide surface 93 than the electric connector 81 protrudes in the third direction.

The second guide surface 93 is a member that contacts with at least part of the supporting plate 731. The second guide surface 93 is configured to guide the supporting plate 731 during detachment or attachment of the process cartridge 10 with respect to the drum cartridge holder 90. The second guide surface 93 has a first guide plate 931 and a second guide plate 932. The first guide plate 931 is inclined with respect to the second direction so that the first guide plate 931 is inclined toward the first guide surface 92 in the inserting direction of the process cartridge 10 from the inserting opening. The first guide plate 931 guides the supporting plate 731 in a direction in which the supporting plate 731 approaches to the electric connector 81 during attachment of the process cartridge 10 with respect to the drum cartridge holder 90. The second guide plate 932 is positioned along the second direction. The second guide plate 932 guides the supporting plate 731 in the inserting direction that is positioned closer to the electric connector 81 by the first guide plate 931.

As illustrated by dashed lines in FIG. 5, the image forming apparatus 100 includes a transfer belt 82 and transfer rollers 83 each of which is positioned in each of the slots 91. The transfer belt 82 is positioned at an end portion opposite to the inserting opening of each slot 91. The transfer roller 83 is positioned at the end portion opposite to the inserting opening of each slot 91. The transfer roller 83 is positioned opposite to the photosensitive drum 72 with respect to the transfer belt 82. In a state where the process cartridge 10 is attached to the slot 91, the outer peripheral surface of the photosensitive drum 72 and the transfer belt 82 contact with each other. Printing sheets pass between the photosensitive drum 72 and the transfer belt 82. The transfer bias is exerted on the transfer roller 83. Accordingly, the developing agent adhering to the outer peripheral surface of the photosensitive drum 72 is transferred to the printing sheet.

As illustrated in FIG. 7, the first guide surface 92 has a first surface 923 and a second surface 924. The first surface 923 is positioned at one side of the electric contact surface 511 in the first direction. The first surface 923 is an inclined surface inclined such that the first surface 923 is closer to the second guide surface 93 as being farther from the electric contact surface 511. The second surface 924 is positioned at the other side of the electric contact surface 511 in the electric contact surface 511. The second surface 924 is an inclined surface inclined such that the second surface 924 is closer to the second guide surface 93 as being farther from the electric contact surface 511.

The first outer surface 52A of the holder 52 contacts with the first surface 923 or the second surface 924 during attachment of the process cartridge 10 with respect to the drum cartridge holder 90. Accordingly, the holder 52 is guided by the first surface 923 or the second surface 924 so as to be inserted in the drum cartridge holder 90. As a result, the holder 52 is fixed in position in the first direction. Accordingly, the electric contact surface 511 can firmly contact with the electric connector 81. Further, the holder 52 is accurately positioned in the first direction and thus a movement of the holder 52 is smooth during detachment of the process cartridge 10 from the drum cartridge holder 90.

<4. Detaching Process of Process Cartridge>

Figure 8:
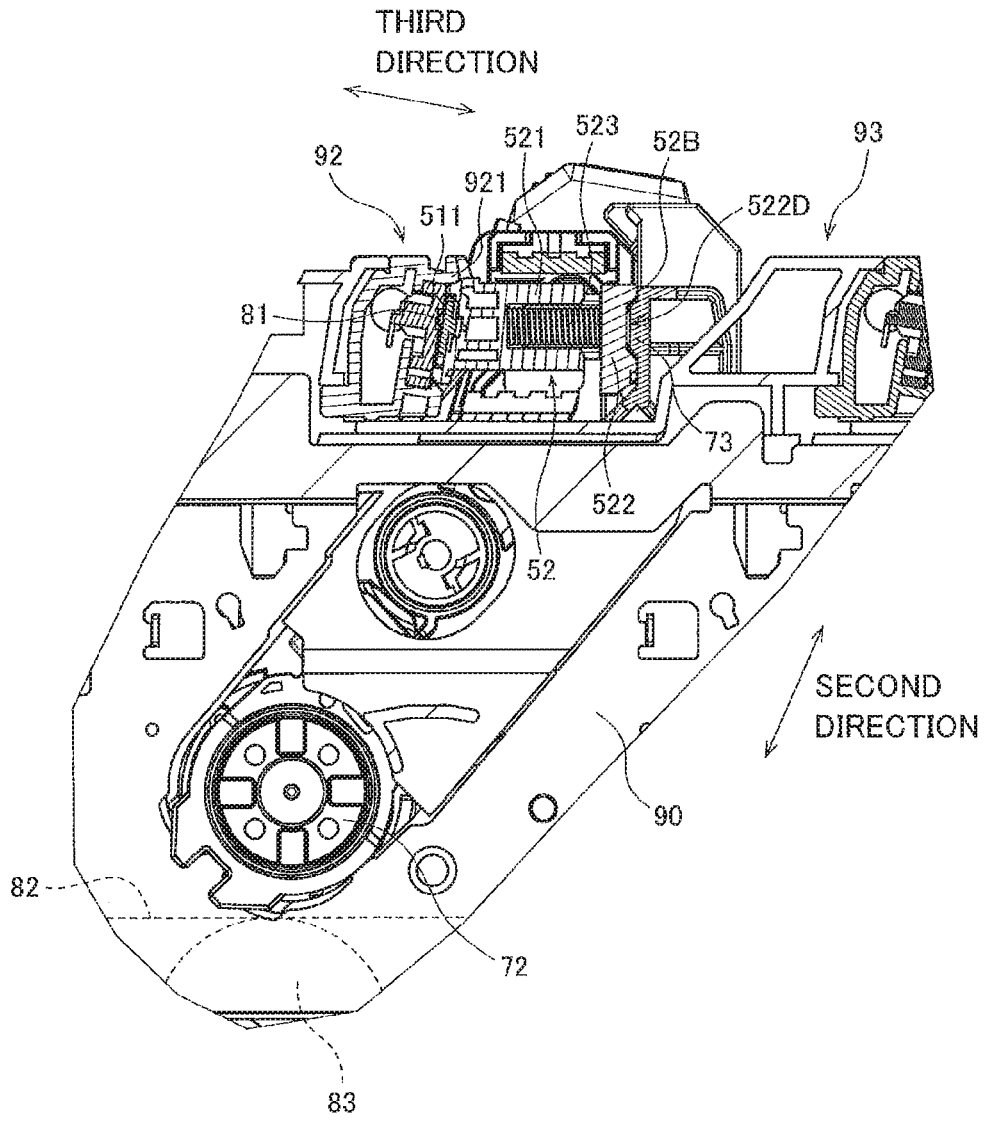
FIG. 8 illustrates detaching process of the process cartridge in which the process cartridge is detached from the drum cartridge supporting portion.
Figure 9:
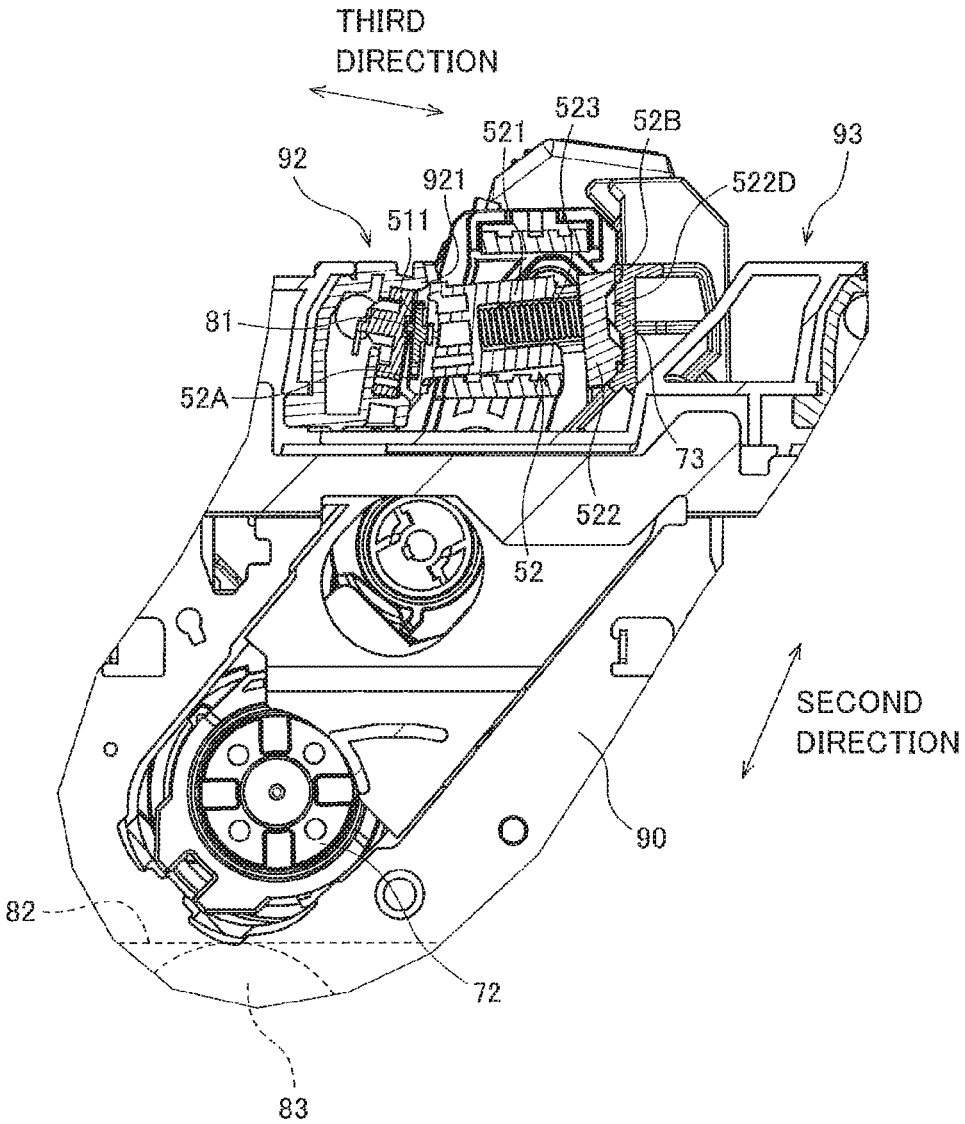
FIG. 9 illustrates detaching process of the process cartridge in which the process cartridge is detached from the drum cartridge supporting portion.
Figure 10:
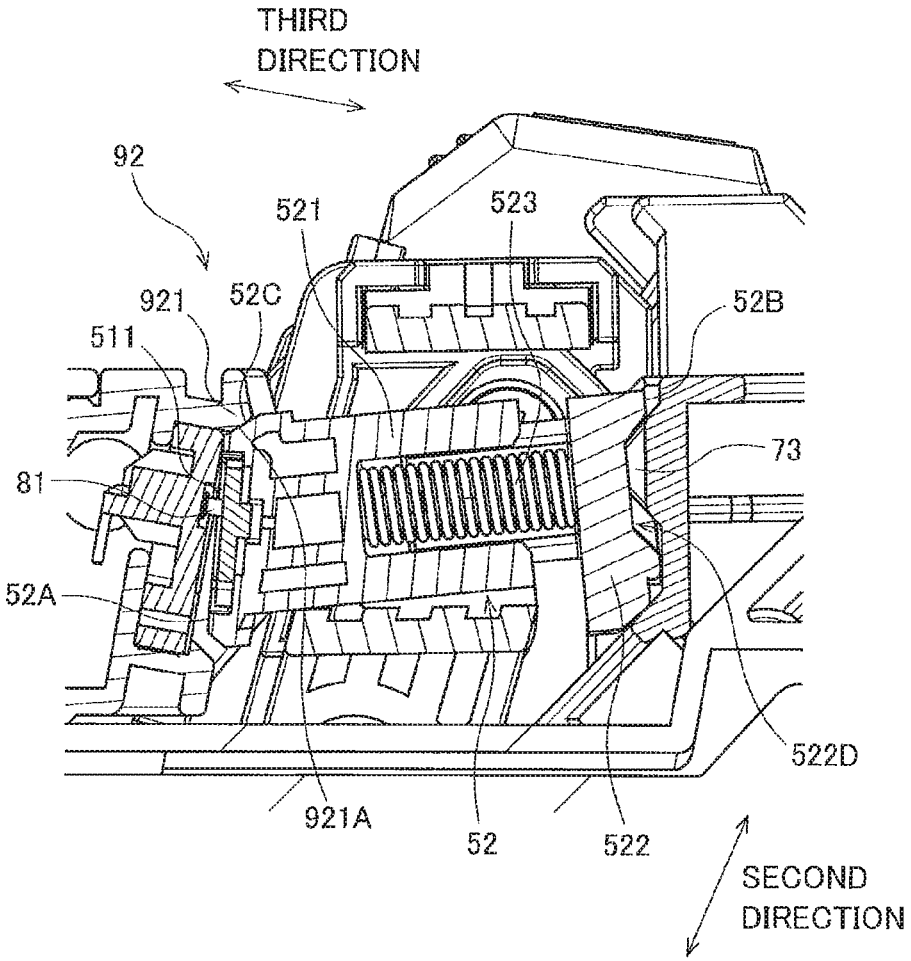
FIG. 10 is an enlarged view of a holder according to the embodiment and an adjacent area of the holder.
Figure 11:
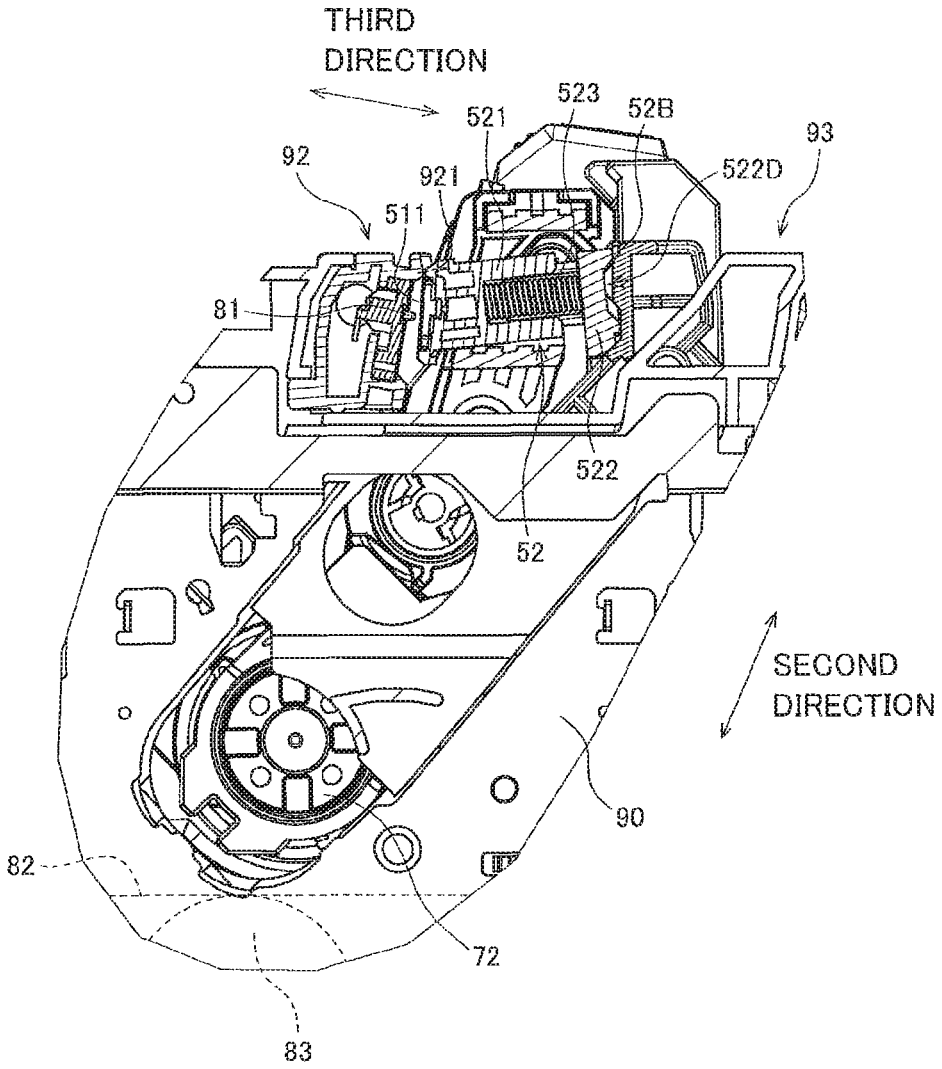
FIG. 11 illustrates detaching process of the process cartridge in which the process cartridge is detached from the drum cartridge supporting portion.
Figure 12:
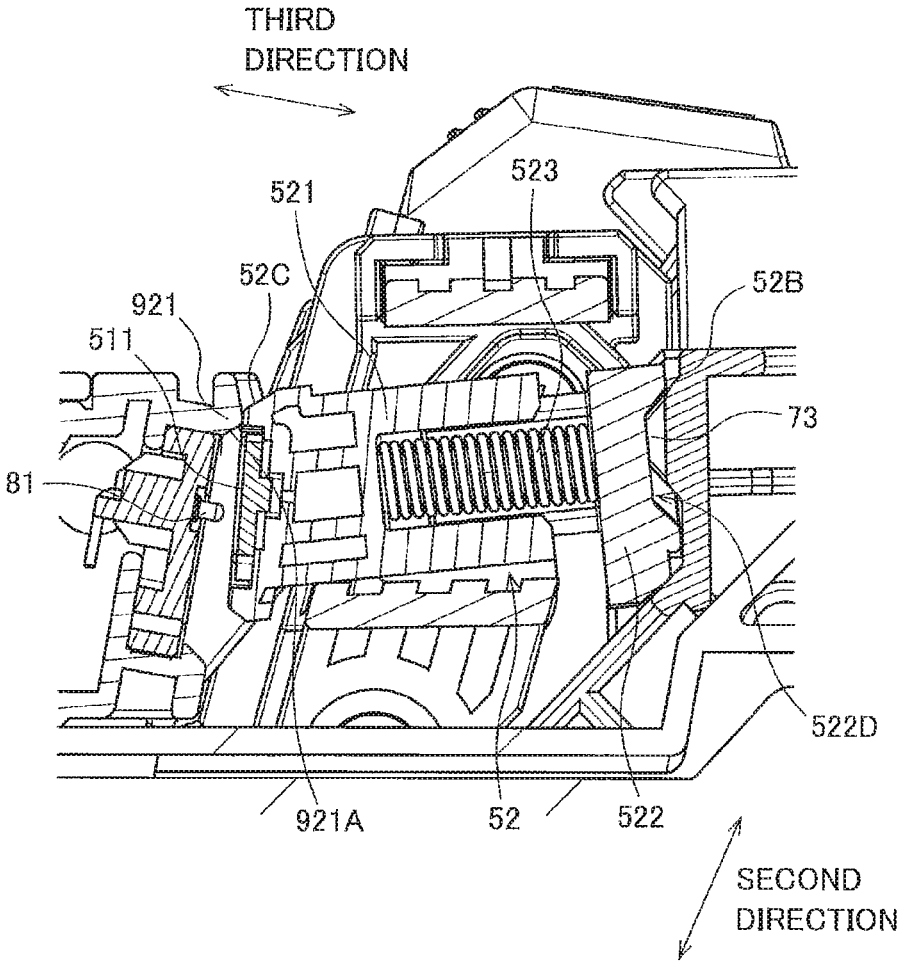
FIG. 12 is an enlarged view of the holder and an adjacent area of the holder.

FIGS. 8, 9, and 11 illustrate the detaching process of the process cartridge 10 in which the process cartridge 10 is detached from the drum cartridge holder 90. FIG. 10 is an enlarged view of FIG. 9 illustrating the holder 52 and an adjacent area of the holder 52. FIG. 12 is an enlarged view of FIG. 11 illustrating the holder 52 and an adjacent area of the holder 52.

FIG. 8 illustrates the process cartridge 10 before being detached from the drum cartridge holder 90. Before the process cartridge 10 is detached from the drum cartridge holder 90, the photosensitive drum 72 is in contact with the transfer belt 82. In that state, the position of the holder 52 with respect to the drum cartridge holder 90 is defined as the first position. In a state where the holder 52 is positioned at the first position, the holder 52 is interposed by the first guide surface 92 and the second guide surface 93 in the third direction, and the electric contact surface 511 of the IC chip 51 contacts with the electric connector 81. Further, in a state where the holder 52 is positioned at the first position, the length of the coil spring 523 in the third direction is the first length.

As illustrated in FIG. 9, during detachment of the process cartridge 10 from the drum cartridge holder 90, the drum cartridge 2 moves in a direction separating away from the transfer belt 82. Accordingly, the photosensitive drum 72 separates from the transfer belt 82, and the second outer surface 52B of the holder 52 also moves in a direction separating from the transfer belt 82. Meanwhile, the first outer surface 52A of the holder 52 contacts with the first protruding portion 921 of the first guide surface 92. Accordingly, a movement of the first outer surface 52A in the second direction is restricted.

As illustrated in FIG. 10, the first protruding portion 921 has a first contact surface 921A. In a state where the process cartridge 10 is attached to the drum cartridge holder 90, the first contact surface 921A and the developing roller 30 are positioned opposite to each other with respect to the electric connector 81 in the second direction. Further, the first contact surface 921A is positioned between the first surface 923 and the second surface 924 in the first direction. On the other hand, the first outer surface 52A of the holder 52 has a second contact surface 52C. The second contact surface 52C is positioned opposite to the developing roller 30 with respect to the electric contact surface 511 in the second direction.

The second contact surface 52C contacts with the first contact surface 921A. Accordingly, the holder 52 pivots about the contacting portion of the first protruding portion 921 and the first outer surface 52A. That is, in a state where the second contact surface 52C contacts with the first contact surface 921A, the holder 52 pivots about the second contact surface 52C. As a result, the position of the holder 52 with respect to the drum cartridge holder 90 moves from the first position to the second position. Here, the first position is illustrated in FIG. 8 and the second position is illustrated in FIGS. 9 and 10.

The electric connector 81 is configured to be compressed and expanded with respect to the first guide surface 92 in the third direction. In a state where the holder 52 is at the second position, the electric connector 81 protrudes further toward the electric contact surface 511 than in a state where the holder 52 is at the first position. Accordingly, the electric contact surface 511 contacts with the electric connector 81 in a state where the holder 52 is positioned at the second position. Further, the length of the coil spring 523 in the third direction is the second length that is longer than the first length in a state where the holder 52 is positioned at the second position.

Accordingly, in a state where the holder 52 moves to the second position from the first position, a movement of the first outer surface 52A in the second direction is restricted by the first protruding portion 921. Accordingly, a movement of the electric contact surface 511 in the second direction relative to the electric connector 81 is restricted. As a result, rubbing of the electric contact surface 511 against the electric connector 81 is suppressed. The pressing force exerted on the electric connector 81 by the electric contact surface 511 is gradually reduced since the coil spring 523 is expanded from the first length to the second length.

As explained above, the holder 52 can move in the second and third directions relative to the casing 11, the gear cover 45, and the holder cover 47. In other words, the holder 52 has at least two degrees of freedom where the holder 52 can move in the second and third directions. Accordingly, the holder 52 can easily pivot in a state where the holder 52 moves from the first position to the second position.

Subsequently, the holder 52 moves from the second position to the third position. Here, the second position is illustrated in FIGS. 9 and 10 and the third position is illustrated in FIGS. 11 and 12. Accordingly, the electric contact surface 511 separates from the electric connector 81. The distance between the photosensitive drum 72 and the transfer belt 82 in a state where the holder 52 is positioned at the third position is longer than the distance in a state where the holder 52 is positioned at the second position. Further, in a state where the holder is positioned at the third position, the length of the coil spring 523 in the third direction is the third length that is longer than the second length.

As illustrated in FIG. 12, the second contact surface 52C is an inclined surface inclined with respect to the second and third directions. In a state where the holder 52 moves from the second position to the third position, the second contact surface 52C moves along the first contact surface 921A in a state where the second contact surface 52C contacts with the first contact surface 921A. Accordingly, the holder 52 can be moved smoothly relative to the first guide surface 92. As a result, the electric contact surface 511 can be separated from the electric connector 81 and rubbing of the electric contact surface 511 against the electric connector 81 is suppressed.

Subsequently, in a state where the process cartridge 10 is completely detached from the drum cartridge supporting portion 90, the first outer surface 52A of the holder 52 separates from the first guide surface 92. Further, the supporting plate 731 of the drum cartridge 2 separates from the second guide surface 93. Accordingly, the length of the coil spring 523 in the third direction becomes the fourth length that is longer than the third length.

<5. Modification>

The embodiment of the disclosure is explained above, and the disclosure is not limited to the above embodiment.

In the embodiment, the coil spring 523 is used as a resilient member. Alternatively, a leaf spring, torsion spring or other springs may be used instead of the coil spring 523.

In the embodiment, the IC chip having the electric contact surface is fixed to the outer surface of the holder. Alternatively, only the electric contact surface contacting the electric connector may be fixed to the outer surface of the holder, and the portion of the IC chip other than the electric contact surface may be positioned at other parts of the developing cartridge.

Further, the details of parts or members configuring the image forming apparatus may be different from the shapes illustrated in each figure of the disclosure. Further, each component in the embodiment or the modification may be suitably combined, if not inconsistent with each other.

What is claimed is:

1. An image forming apparatus comprising:

a developing cartridge including:

a developing roller rotatable about a first rotating axis extending in a first direction;

a casing configured to accommodate a developing agent and having a first end portion, the first end portion being an end portion in a second direction where the developing roller is positioned;

a storage medium having an electric contact surface; and a holder positioned at a second end portion of the casing different from the first end portion, the second end portion being an end portion in the first direction, and holding the electric contact surface, the holder having:

a first outer surface positioned at one side of the holder in a third direction crossing the electric contact surface, and holding the electric contact surface, the second and third directions being different from one another and both being orthogonal to the first direction;

a second outer surface positioned at another side of the holder in the third direction, and positioned away from the first outer surface in the third direction; and a resilient member positioned between the first outer surface and the second outer surface, and configured to be compressed and expanded in the third direction;

a drum cartridge including a photosensitive drum rotatable about a second rotating axis extending in the first direction;

an electric contact configured to be in contact with the electric contact surface; and a frame to which the developing cartridge and the drum cartridge are detachably attachable in a state where the developing cartridge is attached to the drum cartridge, the frame having a first guide surface configured to guide at least a part of the first outer surface, and configured to contact with at least a part of the first outer surface during attachment of the developing cartridge to the frame, the first guide surface having a first contact surface positioned opposite to the developing roller in the second direction with respect to the electric contact surface, wherein the electric contact is supported by the frame and configured to come into contact with the electric contact surface in the state where the developing cartridge is attached to the frame, wherein the holder is movable relative to the frame from a first position to a second position during detachment of the developing cartridge from the frame, wherein, in a state where the holder is positioned at the first position, the resilient member has a first length in the third direction and the electric contact surface is in contact with the electric contact;

wherein, in a state where the holder is positioned at the second position, the resilient member has a second length in the third direction longer than the first length and the electric contact surface is in contact with the electric contact; and wherein, in a state where the holder moves from the first position to the second position, the holder pivots about a part of the first outer surface in a state where the holder is in contact with the first contact surface of the first guide surface.

2. The image forming apparatus according to claim 1, wherein the holder is movable relative to the frame from the second position to a third position during detachment of the developing cartridge from the frame; and wherein, in a state where the holder is positioned at the third position, the resilient member has a third length in the third direction longer than the second length and the electric contact surface is separated away from the electric contact.

3. The image forming apparatus according to claim 2, further comprising a transfer belt configured to contact with the photosensitive drum in a state where the developing cartridge attached to the drum cartridge is attached to the frame;

wherein, in a state where the holder is positioned at the first position, the photosensitive drum is in contact with the transfer belt; and wherein, in a state where the holder is positioned at the second position, the photosensitive drum is separated away from the transfer belt.

4. The image forming apparatus according to claim 2, further comprising a transfer belt configured to contact with the photosensitive drum in a state where the developing cartridge attached to the drum cartridge is attached to the frame;

wherein a distance between the photosensitive drum and the transfer belt in a state where the holder is positioned at the third position is greater than a distance between the photosensitive drum and the transfer belt in a state where the holder is positioned at the second position.

5. The image forming apparatus according to claim 1, wherein the first outer surface has a second contact surface positioned opposite to the developing roller with respect to the electric contact surface in the second direction; and wherein, in a state where the holder moves from the first position to the second position, the holder pivots about the second contact surface in contact with the first contact surface.

6. The image forming apparatus according to claim 5, wherein the second contact surface is an inclined surface inclined with respect to the second direction and the third direction.

7. The image forming apparatus according to claim 1, wherein the drum cartridge further includes a holder support portion configured to contact with the second outer surface in a state where the developing cartridge is attached to the drum cartridge; and wherein the second outer surface is movable in the second direction relative to the holder support portion in a state where the developing cartridge is attached to the drum cartridge.

8. The image forming apparatus according to claim 1, wherein the holder is movable relative to the casing in the second direction and the third direction.

9. The image forming apparatus according to claim 8, wherein one of the holder and the casing has a boss protruding in the first direction, and remaining one of the holder and the casing has one of a recessed portion and a through-hole into which the boss is inserted, one of the recessed portion and the through-hole having a length in the second direction longer than a length of the boss in the second direction, and having a length in the third direction longer than a length of the boss in the third direction.

10. The image forming apparatus according to claim 7, wherein the frame has a second guide surface positioned away from the first guide surface in the third direction, the second guide surface configured to guide at least a part of the holder support portion, the second guide surface being in contact with at least a part of the holder support portion during attachment of the developing cartridge with respect to the frame.

11. The image forming apparatus according to claim 10, wherein the first guide surface has:

a first surface positioned at one side in the first direction of the electric contact surface, the first surface being closer to the second guide surface as being farther from the electric contact surface; and a second surface positioned at another side in the first direction of the electric contact surface, the second surface being closer to the second guide surface as being farther from the electric contact surface.

12. The image forming apparatus according to claim 11, wherein the first outer surface has a second contact surface positioned opposite to the developing roller with respect to the electric contact surface in the second direction; and wherein, in a state where the holder moves from the first position to the second position, the holder pivots about the second contact surface in a state where the second contact surface is in contact with the first contact surface.

13. The image forming apparatus according to claim 12, wherein the first contact surface is positioned between the first surface and the second surface in the first direction.

* * * * *